United States Patent [19]

Ames et al.

[11] Patent Number: 4,669,536

[45] Date of Patent: Jun. 2, 1987

[54] GROUNDWATER MONITORING SYSTEM

[75] Inventors: Kenneth R. Ames, Pasco; James M. Doesburg; Eugene A. Eschbach, both of Richland; Roy C. Kelley, Kennewick; David A. Myers, Richland, all of Wash.

[73] Assignee: Battelle Development Corporation, Columbus, Ohio

[21] Appl. No.: 656,114

[22] Filed: Sep. 27, 1984

[51] Int. Cl.[4] ..... E21B 43/00; E21B 43/04

[52] U.S. Cl. ..... 166/68; 166/51; 166/72; 166/105; 166/385

[58] Field of Search ..... 166/105, 68.5, 67, 68, 166/72, 74, 77, 106, 369, 381, 385, 84, 373, 93–96, 51, 278; 417/259, 328

[56] References Cited

U.S. PATENT DOCUMENTS

| | | | |
|---|---|---|---|
| 1,399,108 | 12/1921 | Garrison | 166/107 UX |
| 1,595,074 | 8/1926 | Crews | 166/68 |
| 1,710,471 | 4/1929 | Cater | 166/381 |
| 2,193,775 | 3/1940 | Stratford | 166/278 |
| 2,198,573 | 4/1940 | Davis et al. | 166/381 X |
| 2,915,986 | 12/1959 | Sisson | 417/550 X |
| 3,018,779 | 1/1962 | Tyler et al. | 417/259 X |
| 3,212,406 | 10/1965 | McDuffie | 166/68.5 |
| 3,273,644 | 9/1966 | Waterman | 166/105 X |
| 3,434,540 | 3/1969 | Stein | 166/278 X |
| 3,640,342 | 2/1972 | Gault | 166/72 |

*Primary Examiner*—Stephen J. Novosad

*Attorney, Agent, or Firm*—Joseph J. Hauth; Robert Keith Sharp

[57] ABSTRACT

A groundwater monitoring system includes a bore, a well casing within and spaced from the bore, and a pump within the casing. A water impermeable seal between the bore and the well casing prevents surface contamination from entering the pump. Above the ground surface is a removable operating means which is connected to the pump piston by a flexible cord. A protective casing extends above ground and has a removable cover. After a groundwater sample has been taken, the cord is disconnected from the operating means. The operating means is removed for taking away, the cord is placed within the protective casing, and the cover closed and locked. The system is thus protected from contamination, as well as from damage by accident or vandalism.

9 Claims, 19 Drawing Figures

GROUNDWATER MONITORING SYSTEM

INTRODUCTION

This invention relates to a groundwater monitoring system. A form of pump useful in the system is shown and claimed in application Ser. No. 656,116 filed on the same date as this application.

BACKGROUND

Groundwater monitoring is required under Federal, State, and local environmental regulations. In order to comply with these regulations, it is necessary to install monitoring wells in the vicinity of regulated facilities. The design and construction of monitoring wells and the attendant sampling equipment is sufficiently different from the equipment required for water supply wells that a new technology has been developed for the monitoring industry.

Two fundamental requirements for monitoring well construction are to construct a well that does not add to the potential pollution problem and to construct a well that can give a representative sample of the groundwater. The monitoring well industry has met these requirements by developing specialized drilling equipment and techniques. Chemists have developed techniques that are on the cutting edge of technology to analyze groundwater samples. Sample analyses in the parts per billion range are commonplace.

The equipment and materials used to sample groundwater require corresponding changes so that they are complementary to drilling and chemical analyses. Specific concerns for sampling equipment include sampling devices formed of materials that will not interact with the chemical constituents that are being analyzed; pumps which do not "strip" volatile components from the groundwater as it is pumped from the ground; sampling equipment that allows for rapid, repetitive sampling without undue cost or labor; and equipment so designed that a wide variety of hydrologic tests can be performed using the same well.

To meet the requirements imposed by exacting chemistry analyses and to minimize the costs of sample and hydrologic data collection, a monitoring well sampling system should:

- Minimize the potential for cross contamination between wells by allowing installation of dedicated pumps in individual wells at reasonable expense.
- Be of such diameter that allows its installation in less expensive small-diameter wells. Be made of long-lasting, non-reactive materials.
- Allow accurate measurement of groundwater elevations. Allow for rapid removal of groundwater during well development and flushing prior to sampling.
- Allow for collection of non-aerated samples. Provide a ready means of monitoring the amount of water removed from the well during flushing and sample collection.
- Provide a ready means of monitoring water quality parameters (pH, temperature, and specific conductance) in the field. Be readily portable and lightweight for carrying to remote locations in the field.

SUMMARY OF THE INVENTION

Our invention includes a well bore which is sunk to a point below the level of the water table. Within and spaced from the wall of the bore is a casing which is made of a cheap but sturdy and stable material, e.g., polyvinylchloride, commonly termed PVC. Between the lower portion of the casing and the well bore is a layer of sand suitable for filtering. Directly above this is a segment of impervious clay such as bentonite which serves to prevent leakage into the sand from the upper portion of the bore. This upper portion surrounding the PVC casing is filled with a concrete grout. At the upper portion of the bore and extending a substantial distance above ground is a protective casing normally made of fairly heavy steel. This protective casing extends above the upper end of the PVC casing and is provided with a removable cover.

In the lower portion of the PVC casing, adjacent the sand filter level, is a pump. The pump may be mounted within the PVC casing in a removable manner or the pump cylinder may be made integral with the PVC casing. The pump is operated by a flexible cord which extends above ground level. An operating means equipped with a so-called "horsehead", which produces a straight-line movement of the cord, is removably mounted on the protective casing. A discharge line made of flexible material extends from the upper portion of the PVC casing and during operation extends over the top of the protective casing to a suitable receptacle.

Monitoring systems are normally operated only intermittently and for relatively brief periods. When a sample has been pumped out, the flexible discharge line is disconnected and may be coiled about the PVC casing. The cord is disconnected from the "horsehead" and is provided with retention means which prevent its passing through a hole in the top of the PVC casing. The cover of the protective casing is then closed and locked in place. The system is then protected from damage by accident or vandalism.

It is necessary to be able to measure the level of the water table quite accurately and the pumping system is so constructed as to permit this.

FIGS. *9a*, *9b* and *9c* are perspective exploded views of the upper end of well casing 4.

Figure 1:
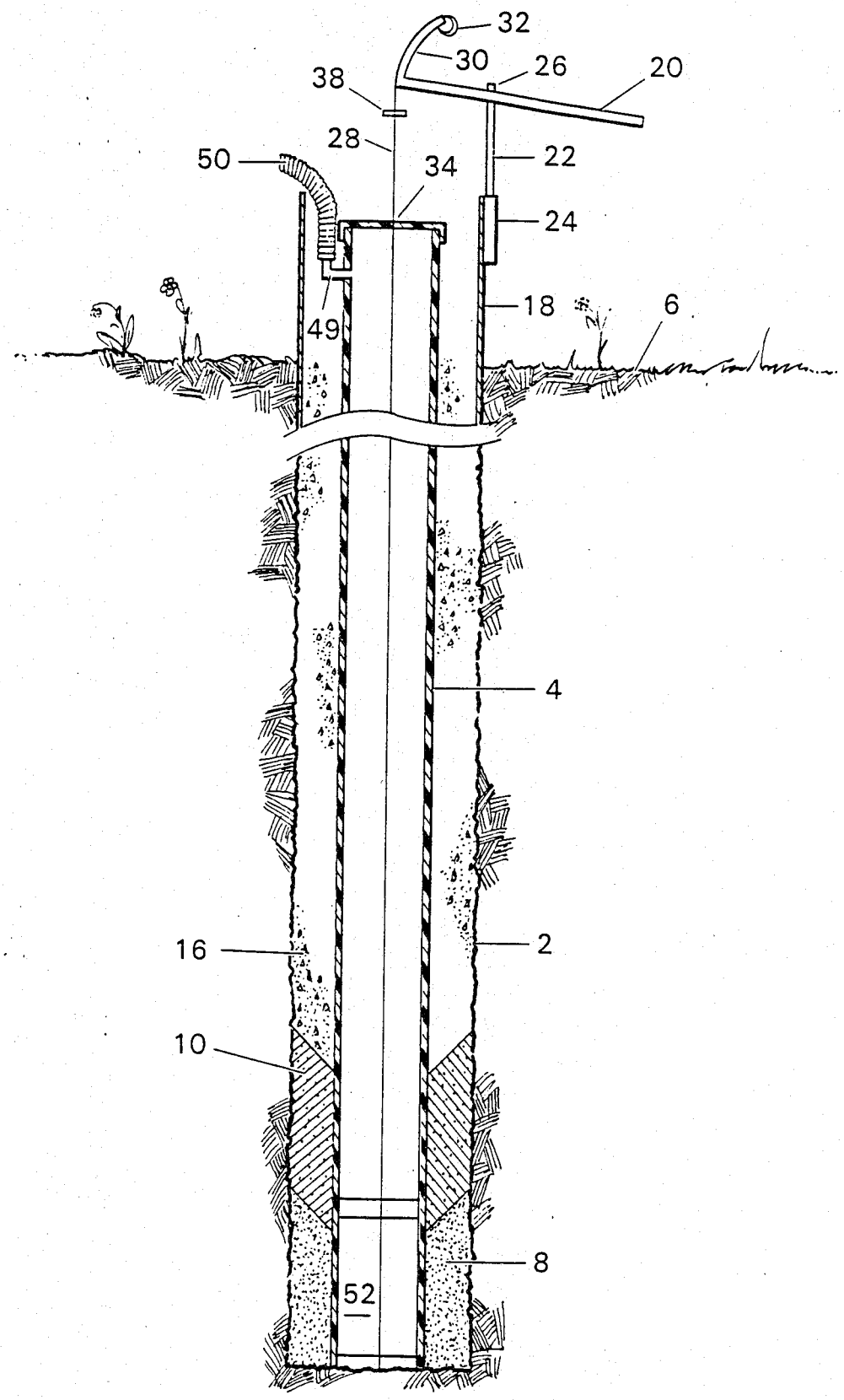
FIG. 1 is a vertical view, largely in section, of one embodiment of the system as a whole.
Figure 10:
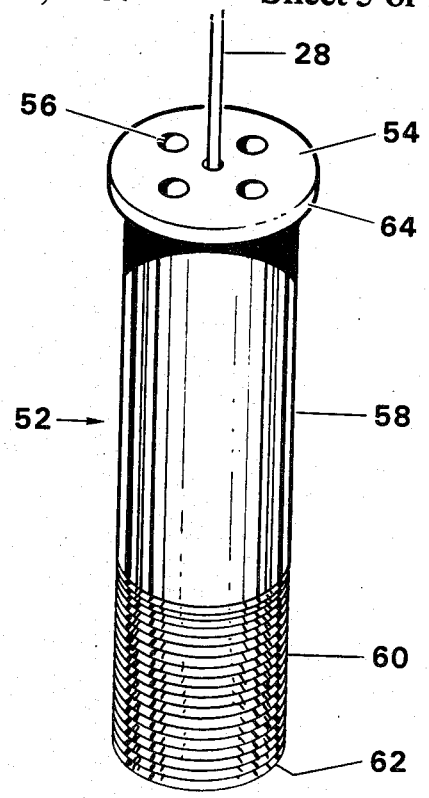

FIG. 10 is a perspective view of one form of pump 52 (FIG. 1).

Figure 11:
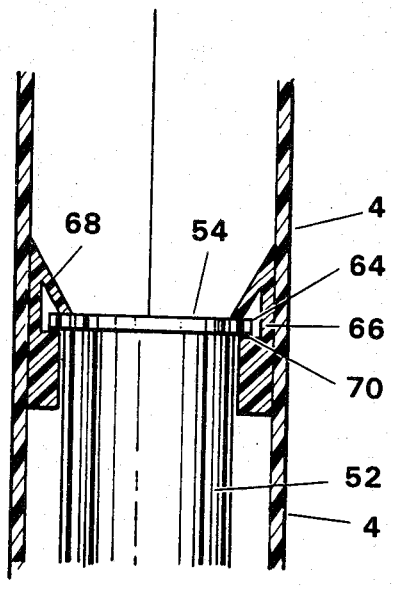

FIG. 11 is a view partially in section, showing the relationship of this form of pump 52 and well casing 4.

Figure 12:
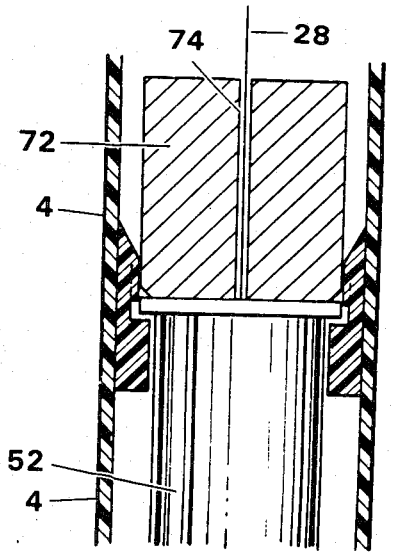

FIG. 12 is a section similar to FIG. 11 showing how pump 52 is removed from well casing 4.

Figure 13:
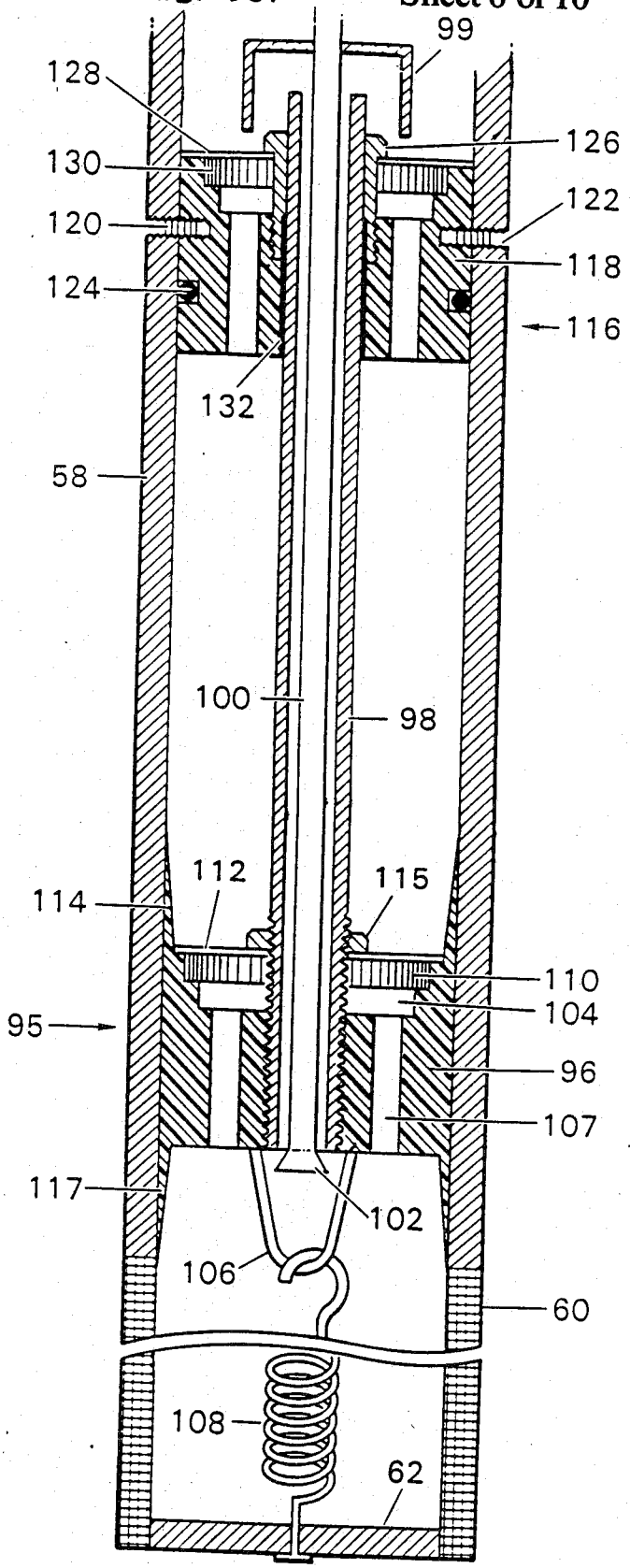

FIG. 13 is a vertical sectional view of the pump of FIGS. 10, 11, and 12.

Figure 14:
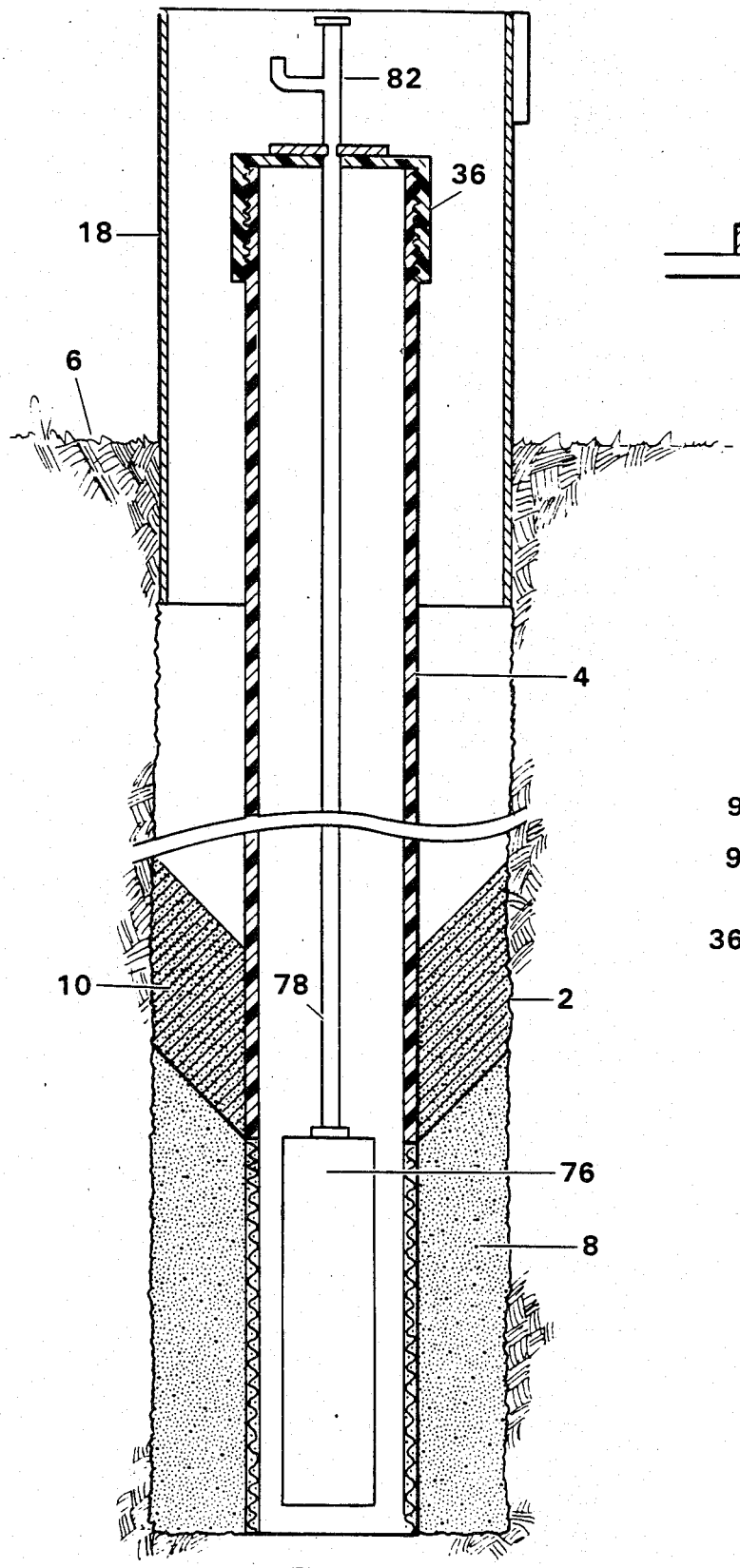

FIG. 14 is a view similar to FIG. 1 showing an alternate system.

Figure 15:
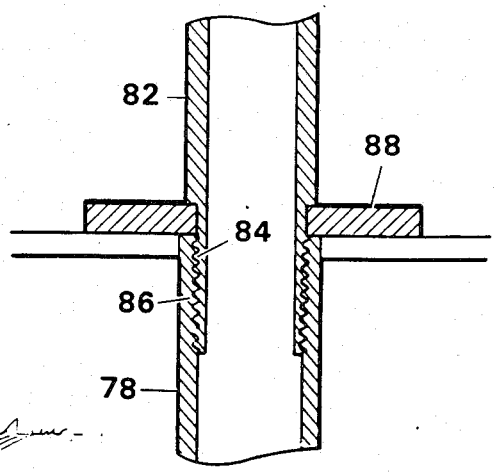
Figure 16:
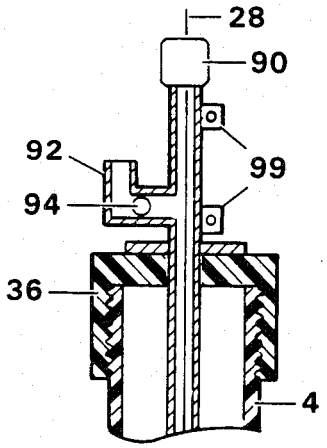

FIGS. 15 and 16 are fragmentary views showing portions of the system of FIG. 14.

Figure 17:
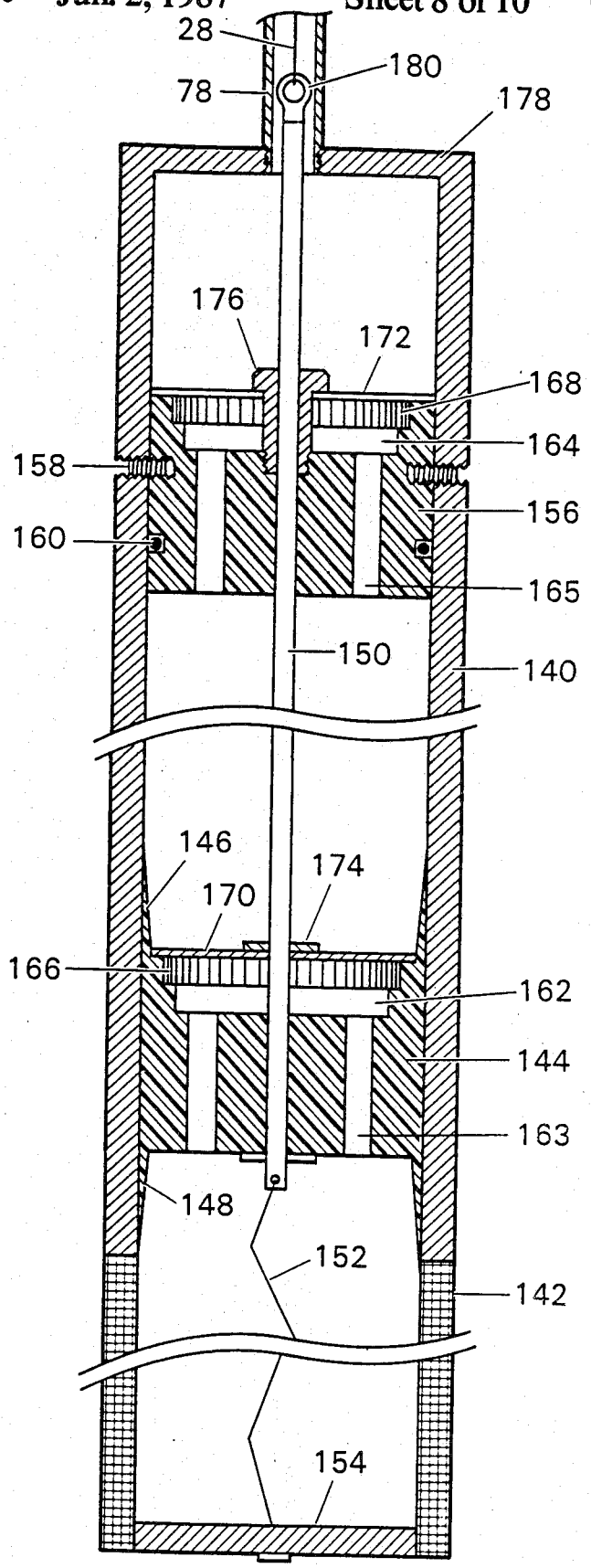

FIG. 17 is a vertical section of a pump suitable for use in the system of FIG. 14.

Figure 18:
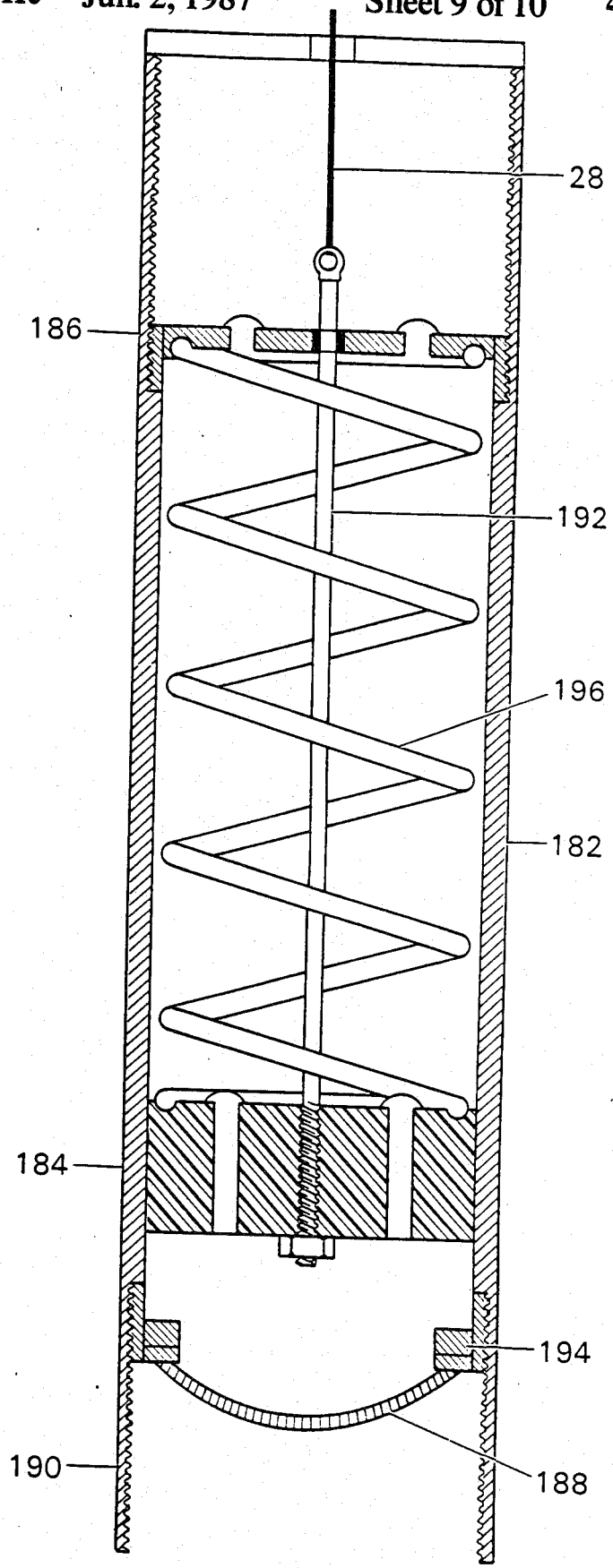

FIG. 18 is a vertical section of another form of pump suitable for use in the system of FIG. 14.

Figure 19:
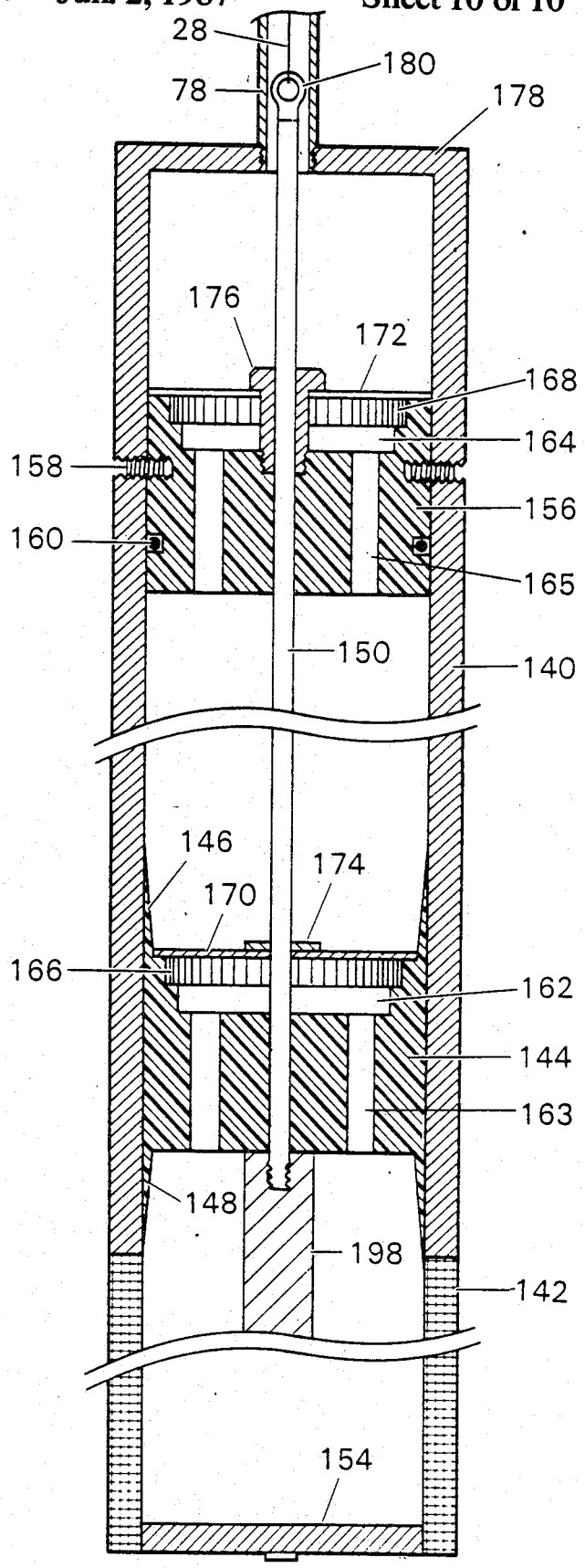

FIG. 19 is a vertical section of still another form of pump suitable for use in the system of FIG. 14.

DETAILED DESCRIPTION

Figure 3:
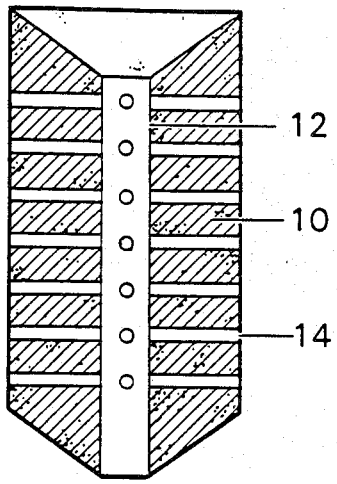
FIG. 3 is a vertical section of the slug shown in FIG. 2.
Figure 2:
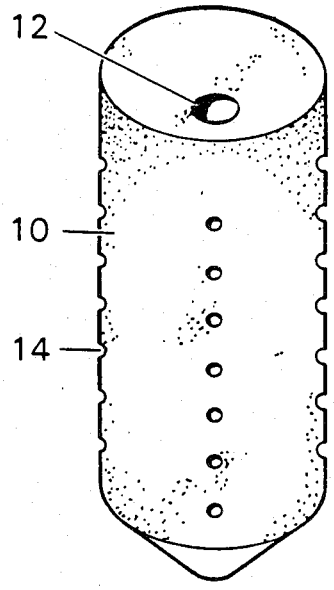
FIG. 2 is a perspective view of a sealing slug forming part of the system.
Figure 4:
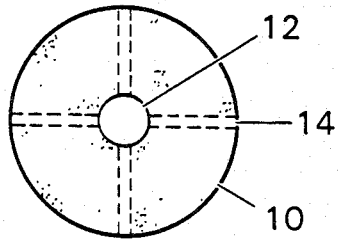
FIG. 4 is a horizontal section of the slug shown in FIG. 2.

FIG. 1 shows one embodiment of our system as a whole. The system includes a bore 2 within which is a PVC casing 4 which extends from a point above the ground level 6 to the bottom of bore 2. Between the lower portions of bore 2 and casing 4 is a layer of sand 8. Above this is a layer of impervious clay such as bentonite 10. The bentonite is originally formed into a self-sustaining slug shown in FIGS. 2, 3, and 4. It is provided with an axial bore 12 of such size as to fit around the casing 4 and with radial bores 14 which serve to aid in wetting of the slug by ground water, which causes it to expand and become impervious to leakage. Above the bentonite layer 10 is a filling of cement grout 16.

Figure 5:
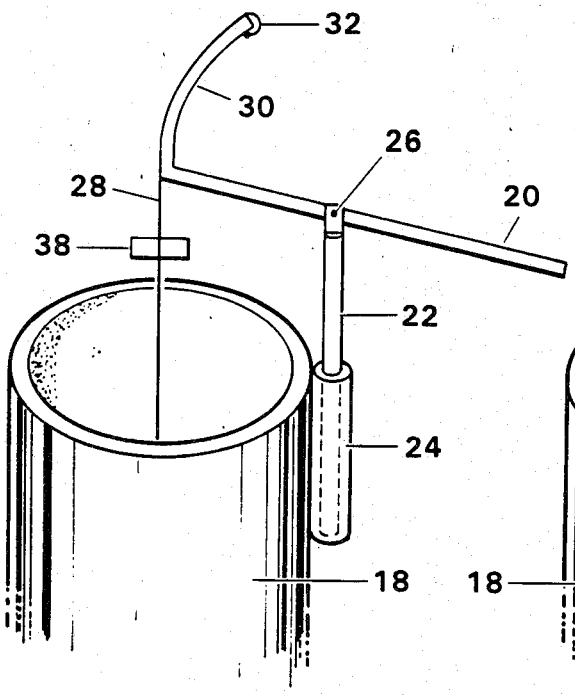
FIGS. 5, 6, and 7 are perspective views showing different mountings for the operating handle 20 (FIG. 1).
Figure 6:
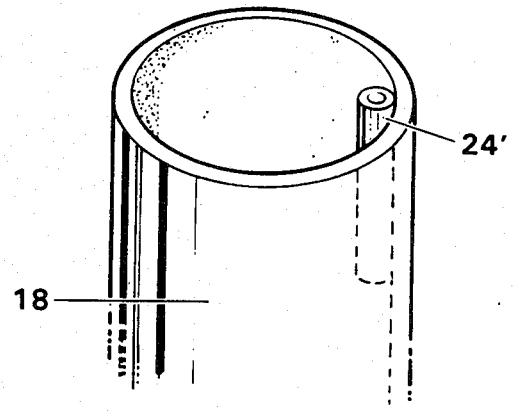
Figure 7:
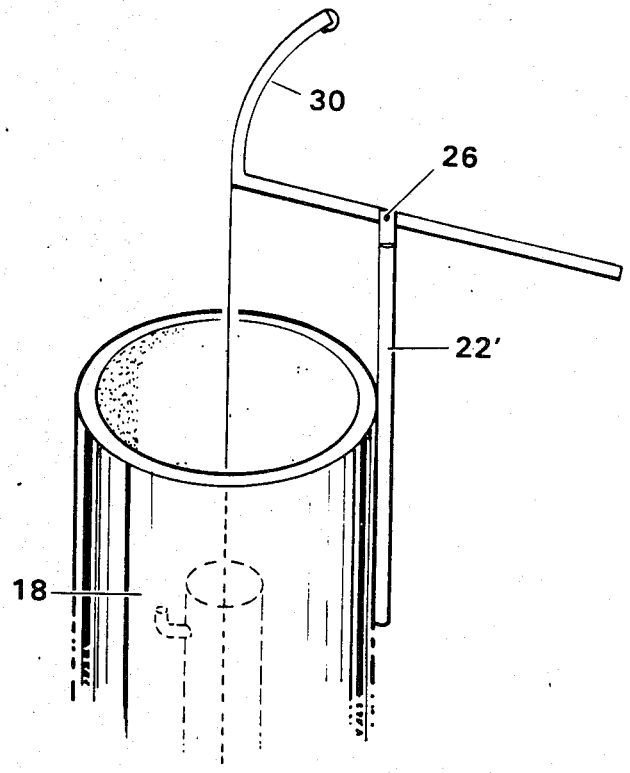

At the upper end of the bore is a protective casing 18 made of fairly heavy steel which extends above the end of the casing 4 and is formed to removably support an operating lever 20. In FIG. 1 this lever is shown pivoted to a vertical support 22 which seats in a socket 24. FIGS. 5, 6, and 7 show various arrangements for supporting the operating lever. In FIG. 5, the arrangement is the same as in FIG. 1, i.e., a short length of pipe 24 is welded to the exterior of protective casing 18. In FIG. 6, a similar pipe length 24' is welded inside of the protective casing. In FIG. 7, a standard 22' is welded to the exterior of casing 18 and the lever 20 is pivoted to the top of the standard by a removable bolt 26.

In each case, the pump is operated by a cord 28 which passes over "horsehead" 30, an arcuate member centered on pivot 26, and terminates in a hook 32. Cord 28 pases through a guide opening 34 in the cover 36 of casing 4. The hook 32 is of sufficient size to prevent cord 28 from falling through opening 34 when the system is disconnected. There may also be stop means 38 attached to cord 28 for added safety.

The cord 28 must be of such a structure that it does not retain and introduce contaminants into the water. A nylon monofilament is suitable from this standpoint but has the disadvantage of stretching to such an extent as to require very frequent adjustment.

A preferable embodiment is a small-diameter twisted or braided wire cable coated with a low-friction, wear-resistant polymer, e.g., PTFE. To avoid exposing ends of the wires to the water, it may be used doubled, with the free ends at the actuating means.

Figure 8:
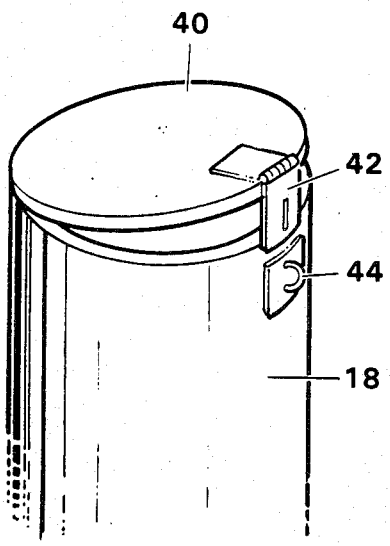
FIG. 8 is a perspective view of the closure for protective casing 18 (FIG. 1).

As shown in FIG. 8, the casing 18 is provided with a hinged cover 40 which is provided with suitable means such as hasp 42 and staple 44 for use with a suitable lock.

Figure 9B:
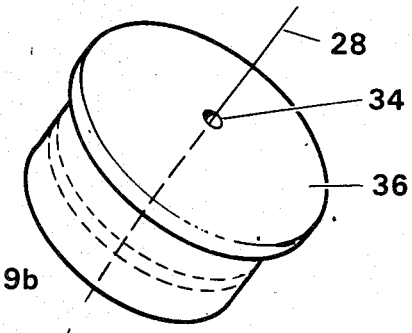
Figure 9C:
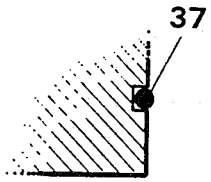
Figure 9A:
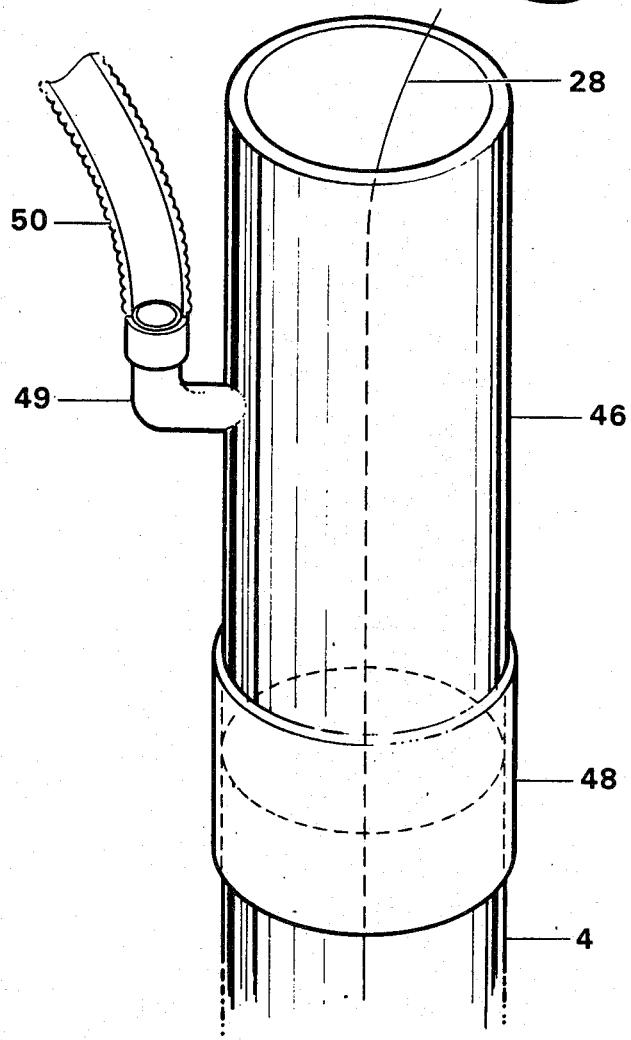

FIGS. 9*a–c* show in more detail the upper end of well casing 4. It includes a discharge tee 46 coupled to the main casing 4 by a coupling 48. It is closed by the cover 36 which is provided with the guide opening 34 referred to above and an O-ring seal 37. The opening 34 is provided with suitable sealing means fitting around cord 28. The discharge tee includes a sidearm 49 over which a flexible discharge tube 50 is fitted.

In the bottom portion of casing 4 is a pump indicated generally as 52. The pump is always located entirely below the surface of the ground water. The pump may take several forms, but all include a piston which is drawn upwardly by cord 28 and moved downwardly by a spring or weight. One form of this pump is shown in FIGS. 10, 11, 12, and 13. In this modification, the pump is provided with a cylinder separate from the well casing 4. The pump cylinder includes a top plate 54 pierced by discharge openings 56, an upper imperforate cylindrical portion 58, a lower cylindrical screen section 60 and a bottom plate 62, which may be partially of screen, but must include rigid portions.

Upper plate 54 includes a lip 64 which extends outwardly beyond cylindrical portion 58. This has the function of securing the pump within casing 4 in a manner which now will be described. Referring to FIG. 11, the casing 4 carries on its interior wall a plurality of spaced mounts 66. Each mount includes a flexible finger 68 and a ledge 70. Upper plate 54 of pump 52 has an outside diameter which is sufficiently smaller than the inside diameter of casing 4 that it will deflect fingers 68 and lip 64 will come to rest on ledges 70 when the pump is lowered into the well. Fingers 68 will then flex outwardly and engage the upper surface of plate 54, holding the pump in place. This relationship is shown in FIG. 11. FIG. 12 shows the manner of removal of the pump. A weight 72 having a central bore 74 and an exterior diameter similar to the diameter of plate 54 is lowered into the well with cord 28 passing through bore 74. In shallow wells, the weight 72 may simply be dropped. In deeper wells, it may be lowered by a cord (not shown). This flexes the fingers 68 as shown. The pump 52 and weight 74 are then raised together.

As an alternative to the above arrangement, the pump cylinder may be made integral with the lower portion of the well casing 4. In this modification, the pump is not withdrawn from the well, but is simply left there permanently.

An alternative embodiment of our system is shown in FIGS. 14, 15, and 16. In this case, the pump 76 is suspended from the cover 36 of the well casing 4 by the discharge pipe 78. The cord 28 extends through this pipe. The manner in which the pipe is supported on cover 36 is best shown in FIGS. 15 and 16. The outlet fixture 82 is provided with threads 84, which screw into threads 86 in pipe 78. A locking washer 88 surrounds the threads of the fixture and when they are tightened into threads 86 of the pipe 78, the locking washer is compressed against cover 36. The top of pipe 78 is closed by a quick release cap 90 and provided with a discharge arm 92 which contains a check valve 94. Brackets 99 are provided for the handle support 22 (FIG. 1) in lieu of the sockets 24 shown in that figure on protective casing 18.

The internal structure of the form of pump particularly suited for use in the system of FIG. 1 will now be described.

Referring to FIG. 13, the pump includes the piston 95 which includes a body 96 into which is threaded a tube 98 extending upwardly from and downwardly through the piston body and open at its upper and lower ends. Hood 99 prevents particulate material from falling into tube 98.

Loosely mounted within the tube 98 is a pump rod 100. The rod 100 has at its lower end an enlarged portion including a conical seat member 102, which engages the open and lower end of tube 98. The piston body 96 is provided with a bail 106 which is connected to a tension spring 108. The other end of spring 108 is connected to a rigid portion of bottom plate 62. The rod 100 is connected to cord 28. The piston body 96 contains a flowchamber 104 from which bores 107 extend downwardly to the bottom of the piston body. Across the top of flowchamber 104 there is a screen 110, which is formed of a number of closely spaced parallel bars. Preferably, these bars are of a trapezoidal shape with the broad side on top and are supported from beneath by other widely spaced trapezoidal bars at right angles to them. This is a known type of screen which has a low resistance to fluid flow. Lying on top of the screen is a disk 112 made of flexible material, preferably polytetrafluoroethylene (PTFE) sold under the trademark, Teflon. The piston body 96 includes side flanges 114, 117 extending about the periphery of disk 112 and downwardly from piston body 96, respectively. The flanges are flexible. The upper flange 114 serves as a seal during the upstroke of the piston. The lower flange 117 prevents entry of grit between the piston and the cylinder. The disk is clamped against the screen by nut 115. The screen and disk combination form a check valve which permits upward flow of water relative to the screen but prevents downward flow.

In the upper portion of the pump casing 58 is an outlet valve assembly 116 which has the same screen and disk structure as the piston 95. The outlet valve assembly comprises a valve body 118 which is held in pump casing 58 by screws 120 which are backed out into holes 122. An O-ring 124 provides a seal between the valve body and the casing. A hollow bolt 126 threaded into the valve body clamps the valve disk 128 to the screen 130. A sleeve 132 provides a sliding seal with tube 98. The remainder of the structure of the outlet valve is the same as that of the piston, except that flanges 114, 117 are unnecessary.

The pump casing 58, screens 60, 110, and 130, bail 106, rod 100, tube 98, hood 99, and spring 108 are preferably made of stainless steel, while piston body 96 and valve body 118 are preferably injection molded PTFE, though other polymeric materials, e.g., polyethylene may be satisfactory.

In use the pump is mounted completely below the water level of the well. When cord 28 is drawn upwardly, rod 100 is raised, causing conical surface 102 to seat against the bottom tubular member 98 and raise the piston. The disk 112 seats on screen 110, raising water within the pump casing and forcing it through the checkvalve 116. When cord 28 is lowered, the spring 108 draws the piston downwardly through the well water raising disk 112 and allowing water to enter the pump chamber. Tube 98 is kept closed during this operation, since at all times the cord 28 and the return spring 108 are acting against each other to hold the conical surface 102 against the lower open end of tube 98. When the pump is not in use, however, tension on the cord is completely relaxed and rod 100 drops so that the tube is open at its lower end. This permits water to drain through tube 98. This is desirable to prevent any holdup of water in the pump which will affect the ground water level, since it is important to measure it very accurately for monitoring purposes.

When the system of FIG. 14 is used, the "drainback" feature is unnecessary, since the pump does not occupy all of casing 4, and tube 98 can be omitted. Such a pump is shown in FIG. 17. The pump includes cylinder 140, the upper portion of which is formed of stainless steel and is impervious. The lower portion 142 is made of screen, also of stainless steel. Within the cylinder is piston body 144, preferably injection molded of PTFE and including flanges 146, 148 extending upwardly and downwardly. The pump rod 150, preferably of stainless steel, extends through piston body 144 and is connected at its lower end to a spring 152. Spring 152 is connected at its lower end to a rigid member 154 at the bottom of the pump casing.

In the upper portion of the pump casing is a discharge valve body 156. This valve body is secured in casing 140 by screws 158 and 158' which are backed out into the casing 140. An O-ring 160 seals the valve body 156 to the pump casing. Valve body 156 is preferably made of cast PTFE and pump rod 150 passes through it with initially an interference fit. After a short time, the reciprocation of pump rod 150 works into a sliding fit with the PTFE. The latter has excellent low-friction properties in contact with steel and this provides a good sliding fit which also forms a very effective seal against leakage by water. The piston body 144 and the valve body 156 include flow chambers 162 and 164, respectively,as well as ports 163, 165. Overlying these flow chambers are screens 166, 168. These screens are preferably made of closely spaced parallel stainless steel bars which widen towards their tops and which are supported from beneath by similar bars extending at right angles to them. This is a well known type of screen which has low resistance to liquid flow. Overlying each of these screens is a flexible disk 170, 172 preferably of PTFE. Disk 170 is held in place on the piston by a snap ring 174 which engages pump rod 150. Disk 172 is held in place by hollow bolt 176 which is threaded into valve body 156. The upper end of pump rod 150 extends through cover 178 of the pump cylinder and carries a swivel 180 which is connected to cord 28.

Still another form of pump is shown in FIG. 18. This modification includes a cylinder 182 within which are a piston 184 and an outlet check valve assembly 186. These may be of conventional construction or may be of the form shown in FIG. 17. A screen 188 which is outwardly convex is provided at the bottom and is surrounded by sidewall guard 190. A pump rod 192 is fastened at its lower end to piston 184 and at its upper end to cord 28. A stop 194 limits downward travel of the piston. A compression spring 196, having a diameter less than the inner diameter of pump cylinder 182 extends from piston 184 to valve assembly 186.

In operation, the piston 184 is drawn upwardly by cord 28 compressing spring 196. When tension is relaxed on cord 28, the piston is forced downwardly by the spring. The substitution of a compression spring mounted between the piston and outlet valve assembly for the tension spring below the piston of the other modifications provides a more compact structure.

A final form of pump is shown in FIG. 19. In this embodiment the springs are omitted and the piston is weighted to cause it to descend when tension is relaxed on cord 28. In this figure, the pump is otherwise of the form shown in FIG. 17 with the weight 198 threaded on the lower end of pump rod 150, below piston 144. It will be understood, however, that a weight may replace spring 108 in the embodiment of FIG. 13. In either case the weight should not be so long as to stir up sediment which may accumulate at the bottom of the pump casing. The weight may also be in other positions, e.g., secured to pump rod 150 (FIGS. 17 and 19) above outlet valve disk 172.

While we have described several embodiments of our invention in detail, it will be apparent to persons skilled in the art that various other changes can be made. We therefore wish our patent coverage to be limited solely by the scope of the appended claims.

We claim as our invention:

1. A ground water monitoring system comprising: a well including a bore; a well casing within and spaced from said bore and extending from the bottom to near the top thereof;

a first water permeable means between the bore and the well casing adjacent the lower ends thereof;

a second water permeable means forming the lower portion of the well casing;

water impermeable means extending between said first water permeable means and the top of said bore, and substantially filling the space between said bore and said well casing;

a pump in said well casing adjacent the lower end thereof, and including a vertically reciprocable piston;

a protective casing fixedly mounted in the bore and extending above ground level;

a removable cover for the upper end of said protective casing;

pump operating means removably mounted on said protective casing;

a flexible cord connected to said piston and said operating means and operable to lift said piston;

means operable to lower said piston;

discharge means in the upper portion of said well casing, below the upper end of said protective casing;

a closed upper end on said cell casing, said closed upper end comprising an aperture through which said flexible cord passes;

means for sealing the aperture about said flexible cord;

said flexible cord being detachable from said operating means and comprising restraining means operable to prevent the end of said cord from passing through said aperture.

2. A well monitoring system as defined in claim 1 in which said pump comprises a pump casing, means for securing said pump casing in said well casing, a vertically reciprocable piston in said pump casing, a valve seat in said pump casing above said piston, said piston and valve seat having check valves mounted thereon operable to permit water to flow upwardly relative to said piston and valve seat, but prevent water from flowing downwardly relative thereto; and a pump rod connected to said piston and extending upwardly through said valve seat, said rod being connected at its upper end to said flexible cord.

3. The groundwater monitoring system as defined in claim 2 wherein said pump further comprises a top plate on the upper end of said pump casing; said top plate comprising guide means for said pump rod and having holes therein to permit upward passage of water.

4. A groundwater monitoring system as defined in claim 3 wherein said top plate comprises a lip extending radially outward beyond said pump casing and said well casing includes locking means operable to releasably engage said lip and hold said pump in position during normal operation.

5. A groundwater monitoring system as defined in claim 4 wherein said means on said well casing engaging said lip comprises inwardly extending elastic means operable to flex against said casing under pressure of said lip when said pump is lowered into place and thereafter flex outwardly from said casing to engage the upper surface of said lip and prevent withdrawal of said pump.

6. A groundwater monitoring system as defined in claim 2 and further including a compression spring between said piston and said valve seat and operable to press said piston down when tension is removed from said cord.

7. A groundwater monitoring system as defined in claim 2 wherein said piston is weighted to cause it to descend when tension is removed from said cord.

8. A groundwater monitoring system as defined in claim 2 and further comprising a tube surrounding and spaced from said piston rod; said tube being connected at its lower end to said piston and extending therethrough and being open at its upper and lower ends; said piston rod comprising a seat adjacent its lower end operable to engage the lower end of said tube when it is pulled upwardly and thereby seal said tube and said piston; said piston rod being free to drop a limited distance when tension is removed from said cable thereby opening the lower end of said tube.

9. A groundwater monitoring system as defined in claim 2 wherein said pump includes a tension spring extending downwardly from said piston and connected to said pump casing; said spring being operable to draw said piston down when tension is released on said cord.

* * * * *